US005449115A

United States Patent [19]

Cannon

[11] Patent Number: 5,449,115

[45] Date of Patent: Sep. 12, 1995

[54] ANTI-ROTTING, SPLIT RESISTANT RAILROAD CROSS TIE

[76] Inventor: Wayne D. Cannon, 382 River Rd., Scarborough, N.Y. 10510

[21] Appl. No.: 177,786

[22] Filed: Jan. 5, 1994

Related U.S. Application Data

[63] Continuation-in-part of Ser. No. 915,529, Jul. 20, 1992, abandoned, which is a continuation-in-part of Ser. No. 615,136, Nov. 9, 1990, abandoned.

[51] Int. Cl.[6] ..... E01B 3/04

[52] U.S. Cl. ..... 238/83; 238/29

[58] Field of Search ..... 238/83, 29, 287, 294, 238/295, 366, 104; 34/13.8, 16.5

[56] References Cited

U.S. PATENT DOCUMENTS

| | | | |
|---|---|---|---|
| 2,583,610 | 1/1952 | Spencer | 238/287 |
| 2,623,300 | 12/1952 | Hudson | 238/83 X |
| 2,690,876 | 10/1954 | Snyder | 238/366 X |
| 2,777,641 | 1/1957 | Snyder | 238/366 X |
| 3,558,049 | 1/1971 | Pennino | 238/83 X |
| 4,202,494 | 5/1980 | Rumell | 238/83 |
| 4,349,151 | 9/1982 | Schumaker | 238/295 X |

OTHER PUBLICATIONS

American Railway Engineering Association, *Manual for Railway Engineering,* Current from Aug. 1, 1991 to Jul. 31, 1992.

*Primary Examiner*—Michael S. Huppert
*Assistant Examiner*—Stephen Gordon
*Attorney, Agent, or Firm*—Pennie & Edmonds

[57] ABSTRACT

A split-resistant wooden rail-road tie is provided with a plurality of horizontally spaced vertical holes throughout the length of the tie to inhibit expansion or propagation of splits that are developed during use and to enable the ties to be more efficiently impregnated with preservatives. Wooden ties are generally cut in rectangular blocks, with the grain generally extending in the longitudinal direction thereof. Each tie is treated by first drilling holes throughout the entire length of the ties and then treated with preservatives. The holes not only prevent further propagation of splits, they provide additional surfaces for breathing during drying and for absorbing preservatives during chemical treatment. The holes provide stress relief which equalize the internal pressures developed within the body of the tie, preventing any split from propagating.

18 Claims, 3 Drawing Sheets

ANTI-ROTTING, SPLIT RESISTANT RAILROAD CROSS TIE

This is a continuation-in-part of prior application Ser. No. 07/915,529, filed Jul. 20, 1992, now abandoned, which is a continuation-in-part of Ser. No. 07/615,136, filed Nov. 9, 1990, now abandoned.

BACKGROUND

A railway is typically formed by laying wooden cross ties at spaced intervals and fixedly attaching a pair of rails thereto. The ties are typically laid on a layer of crushed rocks or gravel.

For example, U.S. Pat.No. 2,623,300 granted to M. S. Hudson discloses a railroad tie having a tie plate recess or dap for accommodating a tie plate. The dap is provided with spaced holes for receiving tie plate spikes. The spikes may then be driven through the holes.

U.S. Pat. No. 3,588,049 granted to Charles J. Pennino discloses a tie having a shallow recess for a tie plate under which a plurality of reinforcing members are driven into predrilled holes passing only through the tie. A rail rests on a tie plate and both are secured to the tie by driving spikes therethrough.

U.S. Pat. No. 4,202,494 granted to James A. Rummel discloses a typical rail line using ties to which the rails are secured by bolts.

U.S. Pat. No. 4,349,151 to Schumaker discloses several embodiments of a bent steel rod holding device for securing a rail and tie plate to a tie.

As cross ties are made of wood and exposed to the harsh natural environment, they need to be treated so that they resist splitting and/or rotting. It is desirable to use hardwood due to their durability and strength characteristics. However, it has been found that normal preservative treatment methods do not completely effectively treat wood, especially hardwood, as the preservatives cannot penetrate adequately throughout the tie. This is especially true when measured against the requirements set forth in the American Wood Preservers' Association which requires at least 3" penetration to adequately preserve the wood.

Attempts have been made in the past to prevent wood from splitting during the curing or drying phase, as disclosed for example in the aforementioned Hudson patent. Hudson provides staggered holes which are drilled vertically or horizontally through the tie, adjacent its ends for purposes of allowing moisture from the center portion of the tie to be released therethrough instead through the ends of the tie.

Hudson, however, does not contemplate any means for permitting preservatives to penetrate into the wood, especially hardwood, and for preventing propagation of cracks or splits in the tie that are developed as a result of exposure to the environment.

SUMMARY OF THE INVENTION

The present invention is an improved railroad tie made of wood having a lower surface for resting on a fixed surface and an upper surface opposite the lower surface for supporting rails. The tie has a plurality of spaced vertical holes extending from the upper surface to the lower surface, with the holes spaced substantially along the entire length of the tie. The holes prevent expansion or propagation of splits and enable the ties to be more efficiently impregnated with wood preservatives.

To form the railroad tie of the present invention, the tie is first drilled so that a plurality of spaced holes extend from the upper surface to the lower surface, with the holes spaced substantially along the entire length of the tie. The holes provide stress relief, preventing splits from propagating. Then the predrilled railroad tie is treated with wood preservative, which is further absorbed through the additional surface areas produced by the holes to completely impregnate the entire tie.

In the present invention, each of the ties is formed with a plurality of circular or round holes completely extending through the upper and lower surfaces.

The railroad ties develop splits or cracks as they are exposed to the natural environment, which can reach extreme cold to hot temperatures, as well as extreme humidity changes. A preset pattern of holes according to the present invention prevents propagation of any split or crack developed in the tie during use. More specifically, when a split develops in the tie, as due to exposure to varying temperatures and humidity, the split tends to propagate. However, when the split reaches any of the holes in the tie, the stress distribution attributed by a round or circular hole prevents the split from propagating. That is, the split stops at the hole.

Moreover, the holes also permit the fungicide and/or preservative to fully penetrate throughout the tie.

Moreover, the crushed rocks or gravel embed into the holes and further inhibit movement of the ties as the trains drive, decelerate and accelerate over these lines, providing a better stable foundation for the rails.

BRIEF DESCRIPTION OF THE DRAWINGS

The invention will be described in conjunction with the drawings in which.

DETAILED DESCRIPTION OF THE DRAWINGS

Figure 3:
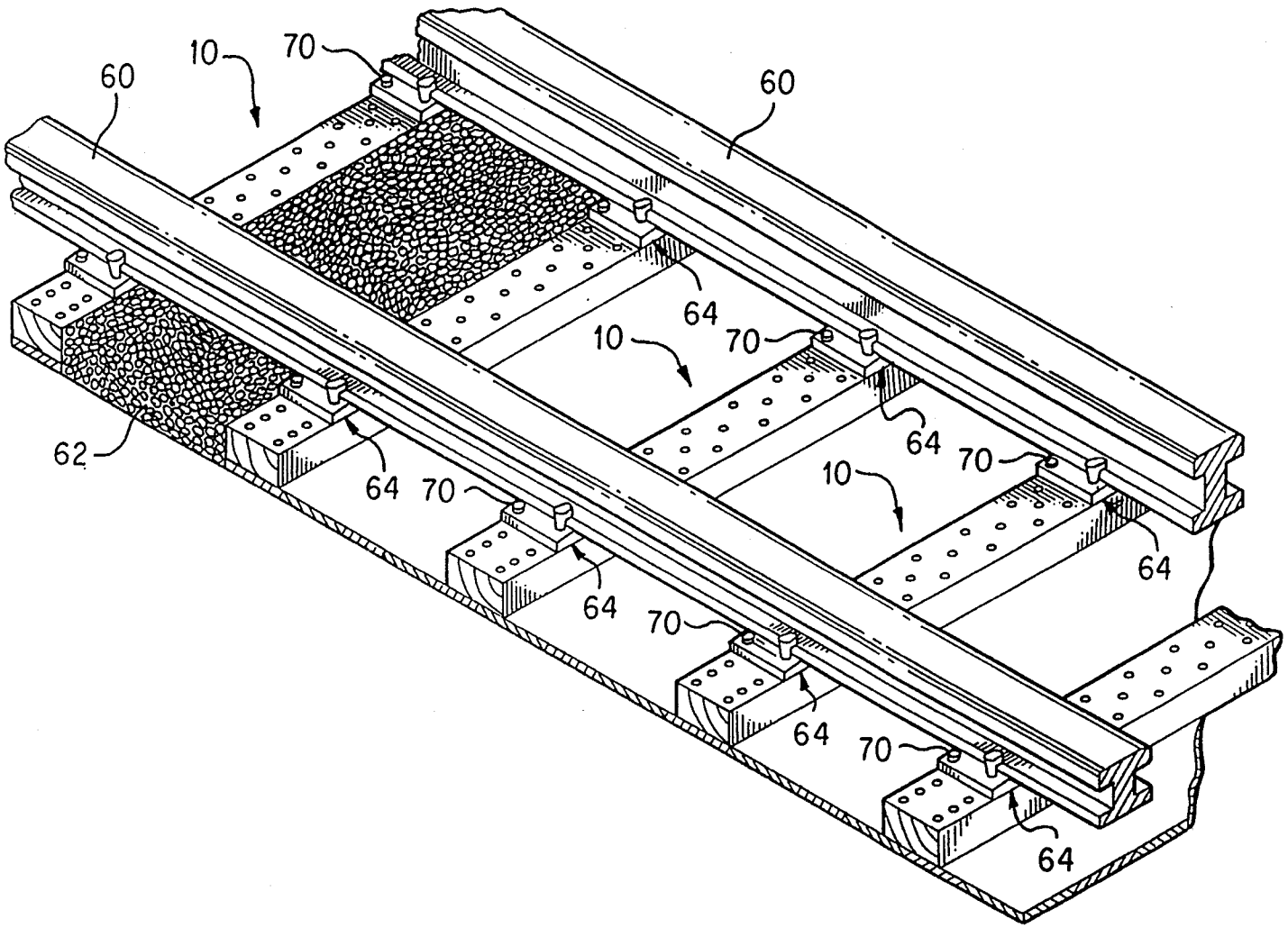
FIG. 3 is a perspective view of a section of a railway.

As shown in FIG. 3, a pair of parallel rails 60 are held stationary relative to the ground using railroad ties 10 and spikes 70. Specifically, spaced ties 10 are laid on the bed of gravel 62 substantially parallel to each other and perpendicular to the rails. The manner of attaching the ties to the ground is deemed conventional and accordingly is not part of the present invention.

While the preferred embodiment of the tie is illustrated with a particular arrangement of holes, the present invention is not to be limited solely thereto. The drawings illustrate one embodiment merely as an example of the present invention.

Moreover, while the preferred embodiment is shown with 3" inch spacings, it is to be noted that the holes may be spaced as great as 6" apart. These spacings ensure the splits from progressing no more than the distance between holes. Moreover, the additional surface areas formed by the holes permit the preserving chemicals applied to the tie to penetrate throughout the tie. It is to be noted that the number of holes may vary depending on the size of the holes. However, for purposes of the present embodiment, all of the holes are preferably about ½" the same size as required for conventional spikes 70. The same drill for boring holes for the spikes can be conveniently used to drill other holes to simplify the manufacturing process.

Wooden ties are generally cut in rectangular blocks, with the grain generally extending in the longitudinal direction thereof. A rectangular railroad tie has four sides running in the longitudinal or lengthwise direction and two ends. Any two opposed sides may be defined respectfully as upper and lower surfaces. However, the railroad ties are generally laid on the ground with the wider side facing the ground for stability.

Figure 1:
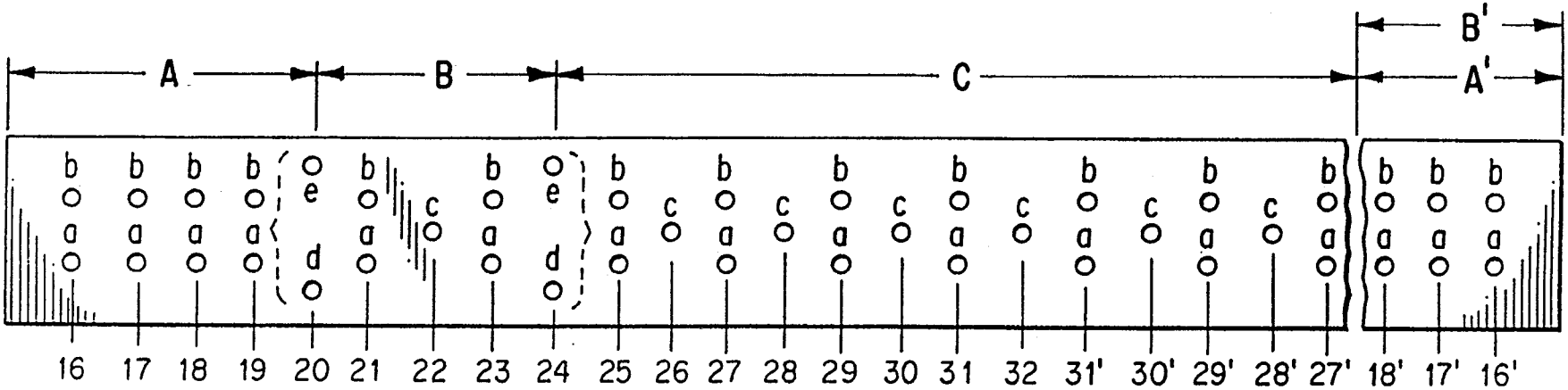
FIG. 1 is a fragmentary top plan view of a railroad tie which has been drilled in accordance with the present invention.
Figure 2:
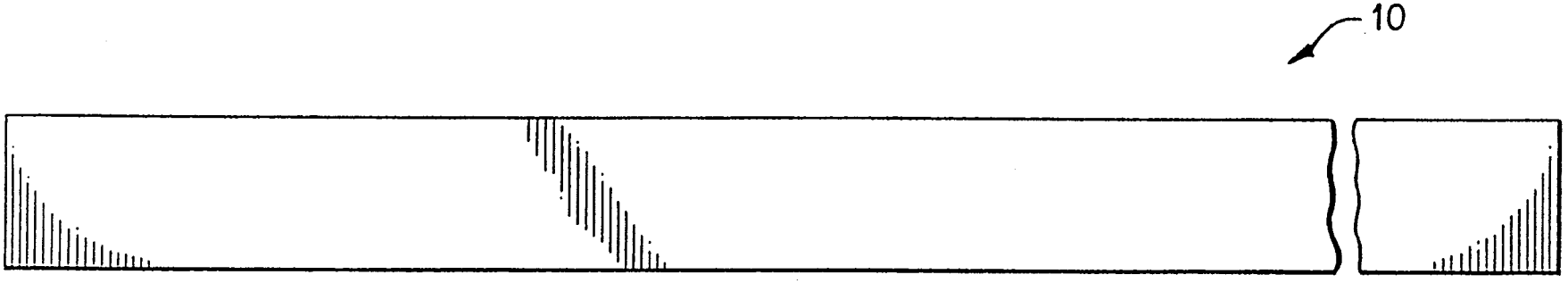
FIG. 2 is a side view of the tie of FIG. 1.

Railroad ties are typically sized to 9" (width)×7" (height)×102" (length). In the present invention, the length of a railroad tie 10 is divided into five sections A, B, C, B' A'. As illustrated in FIG. 1, sequential numbers 16–32 and 16'–32 have been designated to represent the position of the holes, a, b, c, d, e. Position 32 represents the center of the tie, i.e., 51" from either end of the tie. It is to be noted that the segment left of the position 32 is symmetrical to the segment right of the position 32 (mirror image) and the holes are all spaced 3" in the longitudinal direction. As the right section is a mirror image of the left section, detailed description and complete illustration of the right section have been omitted for brevity.

Section A extends 15" from the left end and has two parallel, longitudinal rows of four holes a,b at positions 16, 17, 18 and 19, and extends into holes d,e at position 20 (which forms a part of section B). The holes a,b at positions 16, 17, 18 and 19 are centered 3" from the side edges of the tie and 3" inches apart from each other as shown in FIG. 1. The first pair of holes at position 16 is centered 3" from the left end of the tie.

Section B is a rail securing section extending 12" from position 20 to position 24. Holes d,e are spaced about 6" in the widthwise direction and centered about the width thereof, i.e., positioned 1.5" from the side edges. This section is patterned for the holes formed in the connection plate 64. Holes a, b, c, d, e at positions 20 to 24 are all 3" apart in the lengthwise direction. The holes a,b in the widthwise direction are all 3" apart and 3" from the side edges of the tie. The hole c is centered in the widthwise direction, i.e., 4.5" from either side edge.

Section C is a mid-section of the tie extending 48" from position 24 to 24'. In this section, alternating holes are patterned between holes a,b and c, which are all spaced apart by 3" in the longitudinal direction. Again, holes a,b in the widthwise direction are all 3" apart and 3" from the side edges of the tie. The hole c is centered in the widthwise direction, i.e., 4.5" from either side edge.

As illustrated in FIG. 3, two tie plates 64 are positioned between the rails and each tie. Spikes 70 are driven through the holes formed in the tie plates and in sections B and B' of the tie.

Figure 4:
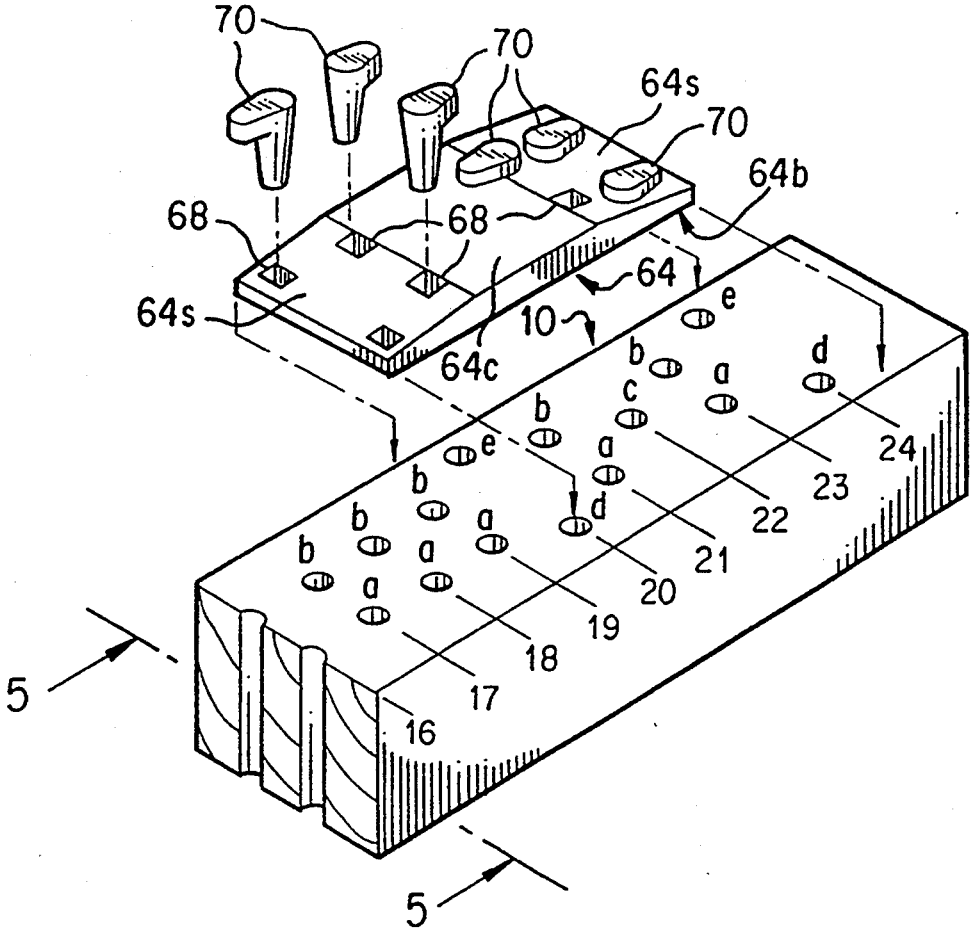
FIG. 4 is a fragmentary exploded view of the left end of the tie showing the tie plate and spikes.

FIG. 4 is an exploded, perspective view of the tie plate 64 and a fragmentary left end of the tie shown in detail. The tie plate 64 is a conventional plate, as shown in the handbook of the American Railway Engineers Association, which has a relatively flat trapezoidal cross-section, i.e., a flat bottom surface **64*b*, a pair of opposed sloping sections 64*s* adjacent either side of a flat center section 64*c* on which the flange of the rail rests. Each sloping section 64*s* has four holes 68 corresponding to holes a,b and d,e at positions 21,20 and 23,24 (and corresponding positions 21', 20' and 23', 24' at the right side), respectively. In other words, the holes 68 align with the holes a,b and d,e when the tie plate is positioned in sections B and B'. Spikes 70** are used to fixedly attach the plate and the rails to the ties.

Note that sections B and B' is provided with holes c at positions 22 and 22'. These holes are provided to prevent further propagation of splits and to allow full penetration of the treating chemicals throughout the tie. All the holes are drilled to the same diameter (½") in the present embodiment for purposes of simplifying the manufacturing process. The diameter is such that the shanks of spikes are firmly held in the holes.

Figure 5:
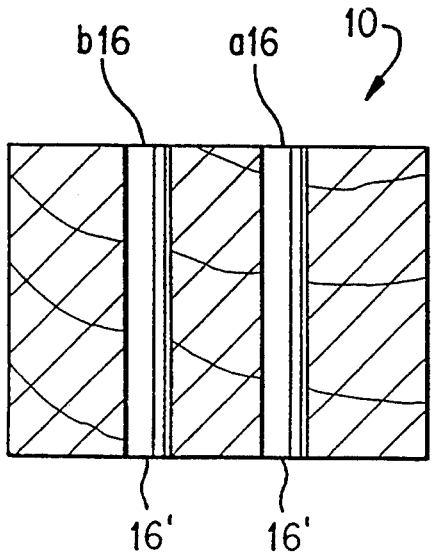
FIG. 5 is a left end view of the tie viewed from the lines 5—5 of FIG. 4, showing two throughholes.

FIG. 5 is a cross sectional view of the tie showing the holes a,b at position 16. The holes provide additional surface 16'through which a solution or solutions may be introduced or absorbed into the tie.

The description of the process for treating wooden ties according to the present invention follows below.

A railroad tie is made by cutting wood so that the finished product is approximately 9"×7"×102" or any conventional railroad tie size, with the grain preferably running in the lengthwise direction thereof.

The tie is drilled with holes having 3" to 6" spacings in the lengthwise direction of the tie and then cured or dried. The preferable size of the holes is ½", the same size as the holes for the spikes.

The tie is then treated with preservatives in a conventional manner.

Due to predrilling of holes before the ties are cured, the drilled holes form additional surfaces which cause even drying and relieve local pressures caused by drying (or freezing) and provide drainage or additional breathing surfaces. Accordingly, the finished tie has less warp and splits. Moreover, the holes additionally prevent propagation of splits that are developed as it is exposed to harsh environment.

Accordingly, the railroad tie and method for production thereof according to the present invention prevent splits or cracks from propagating throughout the tie.

Moreover, the present invention permits more efficient impregnation of wood preservatives or fungicides into the railroad ties.

Moreover, the tie according to the present invention provides additional areas for gravel to embed, thereby further stabilizing the rails when laid in the railway.

Although the invention has been illustrated and described in conjunction with the presently preferred embodiment thereof, it will be understood by those skilled in the art that modifications and variations may be made without departing from the spirit of the invention and the scope thereof as defined in the following claims.

I claim:

1. A split resistant wooden railroad tie having a lower surface for resting on a fixed surface and an upper surface opposite said lower surface for supporting rails, comprising:

at least two rows of spaced vertical holes spaced between about 3" to 6" apart in the longitudinal direction of the tie, said holes extending from said upper surface to said lower surface and formed along the entire length of the tie, wherein said holes i) equalize any internal pressures developed within the tie to prevent splits from developing and limit expansion or propagation of any split to within adjacent holes in the longitudinal direction of the tie;

ii) enable the tie to be more efficiently impregnated with wood preservatives to prevent wood from rotting; and iii) provide a better stable foundation for the rails as crushed rocks or gravel can embed into said holes and further inhibit movement of the ties as trains pass, decelerate and accelerate over the ties.

2. A split resistant wooden railroad tie having a lower surface for resting on a fixed surface and an upper surface opposite said lower surface for supporting rails, comprising:

at least first two rows of vertical holes spaced between about 3" to 6" apart in the longitudinal direction of the tie, said holes extending from said upper surface to said lower surface and formed along the entire length of the tie, wherein said holes equalize any internal pressures developed within the tie to prevent splits from developing and limit expansion or propagation of any split to within adjacent holes in the longitudinal direction of the tie and enable the tie to be more efficiently impregnated with wood preservatives to prevent wood from rotting.

3. The railroad tie according to claim 2, wherein said tie has a left end section and a right end section, wherein some of said first rows of holes are positioned within each of said left end section and said right end section.

4. The railroad tie according to claim 3, wherein the holes of each row positioned within each of said left end and right end sections are spaced equidistant from each other in the lengthwise direction of the tie.

5. The railroad tie according to claim 4, wherein said first rows are symmetrically positioned about the tie in the widthwise direction of the tie, wherein spacing of one of said first rows from one side edge of the tie which extends along the lengthwise direction of said tie is equal to spacing of the other of said first rows from the opposite side edge of the tie.

6. The railroad tie according to claim 5, wherein each row in each of said left end and right end sections has at least 4 holes spaced equally in the lengthwise direction of the tie.

7. The railroad tie according to claim 2, wherein said first rows are spaced apart by about three inches in the widthwise direction of the tie.

8. The railroad tie according to claim 3, further including a left tie plate section inward of and contiguous with said left end section and a right tie plate section inward of and contiguous with said right end section, wherein some of said first rows of holes are positioned within each of said left and right end sections.

9. The railroad tie according to claim 8, wherein each of said left and right tie plate sections additionally includes second two rows of vertical holes extending in the lengthwise direction of said tie.

10. The railroad tie according to claim 9, wherein said second rows of holes are spaced equidistant from opposed side edges which extend along the lengthwise direction of said tie, but positioned closer to the side edges than said first rows of holes.

11. The railroad tie according to claim 10, wherein said second rows are spaced apart by about six inches in the widthwise direction of the tie and said first rows are spaced apart by about three inches in the widthwise direction of the tie.

12. The railroad tie according to claim 11, wherein the holes in said second rows are spaced apart greater in the lengthwise direction of the tie than the holes in said first rows.

13. The railroad tie according to claim 12, wherein the holes in said first rows are spaced apart by about six inches in the lengthwise direction of said tie in each of said left and right tie plate sections.

14. The railroad tie according to claim 8, wherein said tie has a central section inward of and contiguous with said left and right tie plate sections, wherein some of said first rows of holes are positioned within said central section, the holes in said first rows in said central section being spaced apart further in the lengthwise direction than the holes in said first rows in each of said left and right end sections.

15. The railroad tie according to claim 14, wherein the holes in said first rows within said central section are spaced apart by about six inches in the lengthwise direction of the tie and the holes of said first rows within each of said left and right end sections are spaced apart by about three inches.

16. The railroad tie according to claim 15, wherein said central section further includes a central row of vertical holes formed centrally between said first rows.

17. The railroad tie according to claim 16, wherein the holes in said central row are spaced apart by about six inches in the lengthwise direction of said tie.

18. The railroad tie according to claim 17, wherein each of the holes in said central row is positioned between an adjacent pair of holes of at least one of said first rows.

* * * * *